US007922071B2

(12) United States Patent
Robertson et al.

(10) Patent No.: US 7,922,071 B2
(45) **Date of Patent: *Apr. 12, 2011**

(54) MULTI WALLED CONTAINER AND METHOD

(75) Inventors: Ronald D. Robertson, Kansas City, MO (US); George E. Mac Ewen, Kansas City, MO (US)

(73) Assignee: Huhtamaki, Inc., Desoto, KS (US)

( * ) Notice: Subject to any disclaimer, the term of this patent is extended or adjusted under 35 U.S.C. 154(b) by 231 days.

This patent is subject to a terminal disclaimer.

(21) Appl. No.: 12/186,390

(22) Filed: Aug. 5, 2008

(65) Prior Publication Data

US 2008/0290103 A1 Nov. 27, 2008

Related U.S. Application Data

(63) Continuation of application No. 11/548,858, filed on Oct. 12, 2006, now Pat. No. 7,458,504.

(51) Int. Cl.
*B65D 3/22* (2006.01)
*B65D 3/28* (2006.01)

(52) U.S. Cl. ..... 229/403; 220/62.12; 220/62.18; 220/62.2

(58) Field of Classification Search ..... 229/4.5, 229/400, 403; 220/62.12, 62.18, 62.2, 737, 220/738, 739

See application file for complete search history.

(56) References Cited

U.S. PATENT DOCUMENTS

| | | | |
|---|---|---|---|
| 154,498 | A | 8/1874 | Long |
| 411,096 | A | 9/1889 | Eaton et al. |
| 1,091,526 | A | 3/1914 | Moore |
| 1,098,178 | A | 5/1914 | Semple |
| 1,158,581 | A | 11/1915 | Swift, Jr. |
| 1,208,483 | A | 12/1916 | Chesbrough |
| 1,284,728 | A | 11/1918 | Luellen |
| 1,294,210 | A | 2/1919 | Wallertz |
| 1,297,152 | A | 3/1919 | Hackney |
| 1,334,302 | A | 3/1920 | Hicks |
| 1,407,688 | A | 2/1922 | Banton |
| 1,665,033 | A | 4/1928 | Jensen |
| 1,756,243 | A | 4/1930 | Benson |
| 1,771,765 | A | 7/1930 | Benson |
| 1,850,013 | A | 3/1932 | Hinkley |
| 2,051,076 | A | 8/1936 | Deakin |
| 2,155,487 | A | 4/1939 | Hatch |
| 2,252,360 | A | 8/1941 | Barbieri |
| 2,266,828 | A | 12/1941 | Sykes |
| 2,444,861 | A | 7/1948 | Symmes |
| 2,457,198 | A | 12/1948 | Bell |
| 2,512,602 | A | 6/1950 | Bell |
| 2,563,352 | A | 8/1951 | Morse |
| 2,591,578 | A | 4/1952 | McNealy et al. |
| 2,661,889 | A | 12/1953 | Phinney |
| 2,917,215 | A | 3/1956 | Psaty et al. |

(Continued)

FOREIGN PATENT DOCUMENTS

| | | | |
|---|---|---|---|
| EP | 371918 | B1 | 6/1990 |

(Continued)

*Primary Examiner* — Gary E Elkins
(74) *Attorney, Agent, or Firm* — Husch Blackwell LLP

(57) ABSTRACT

A container and method of manufacture are provided. The container includes a cup with a permanently attached sleeve overlying an exterior portion of the cup sidewall. The sleeve includes a plurality of inwardly directed protuberances providing a gap between a substantial portion of the cup sidewall and the sleeve.

12 Claims, 4 Drawing Sheets

U.S. PATENT DOCUMENTS

| | | | |
|---|---|---|---|
| 2,828,903 | A | 4/1958 | Adkins |
| 2,830,005 | A | 4/1958 | Jackson |
| 2,853,222 | A | 9/1958 | Gallagher |
| 2,954,913 | A | 10/1960 | Rossman |
| 3,001,683 | A | 9/1961 | Goodwin et al. |
| 3,079,027 | A | 2/1963 | Edwards |
| 3,106,327 | A | 10/1963 | Karl |
| 3,194,468 | A | 7/1965 | Baron |
| 3,203,611 | A | 8/1965 | Anderson et al. |
| 3,242,829 | A | 3/1966 | White |
| 3,383,025 | A | 5/1968 | Ferrey et al. |
| 3,410,473 | A | 11/1968 | Petrie |
| 3,414,184 | A | 12/1968 | Loheed |
| 3,443,715 | A | 5/1969 | Edwards |
| 3,456,860 | A | 7/1969 | Janninck |
| 3,456,863 | A | 7/1969 | Mollison et al. |
| 3,503,310 | A | 3/1970 | Goetz |
| 3,581,972 | A | 6/1971 | Buchner et al. |
| 3,759,437 | A | 9/1973 | Amberg |
| 3,908,523 | A | 9/1975 | Shikaya |
| 4,080,880 | A | 3/1978 | Shikaya |
| 4,261,501 | A | 4/1981 | Watkins et al. |
| 4,347,934 | A | 9/1982 | Goodman |
| 4,398,650 | A | 8/1983 | Holmes et al. |
| 4,578,329 | A | 3/1986 | Holsappel |
| 4,836,400 | A | 6/1989 | Chaffey et al. |
| 4,842,906 | A | 6/1989 | Ekdahl et al. |
| 4,993,580 | A | 2/1991 | Smith |
| 5,092,485 | A | 3/1992 | Lee |
| 5,102,036 | A | 4/1992 | Orr et al. |
| 5,145,107 | A | 9/1992 | Silver et al. |
| 5,203,490 | A | 4/1993 | Roe |
| 5,205,473 | A | 4/1993 | Coffin, Sr. |
| 5,226,585 | A | 7/1993 | Vorano |
| 5,256,131 | A | 10/1993 | Owens et al. |
| 5,259,529 | A | 11/1993 | Coale |
| 5,326,019 | A | 7/1994 | Wolff |
| 5,363,982 | A | 11/1994 | Sadlier |
| 5,385,260 | A | 1/1995 | Gatcomb |
| 5,415,339 | A | 5/1995 | Howard |
| 5,425,497 | A | 6/1995 | Sorensen |
| 5,454,484 | A | 10/1995 | Chelossi |
| 5,460,323 | A | 10/1995 | Titus |
| 5,490,631 | A | 2/1996 | Iioka et al. |
| 5,542,559 | A | 8/1996 | Kawakami et al. |
| 5,547,124 | A | 8/1996 | Mueller |
| 5,660,326 | A | 8/1997 | Varano et al. |
| 5,669,553 | A | 9/1997 | Smith |
| 5,685,480 | A | 11/1997 | Choi |
| 5,697,550 | A | 12/1997 | Varano et al. |
| 5,766,709 | A | 6/1998 | Geddes et al. |
| 5,769,311 | A | 6/1998 | Morita et al. |
| 5,775,577 | A | 7/1998 | Titus |
| 5,820,016 | A | 10/1998 | Stropkay |
| 5,857,615 | A | 1/1999 | Rose |
| 5,952,068 | A | 9/1999 | Neale et al. |
| 5,964,400 | A | 10/1999 | Varano et al. |
| 6,039,682 | A | 3/2000 | Dees et al. |
| 6,085,970 | A | 7/2000 | Sadlier |
| 6,186,394 | B1 | 2/2001 | Dees et al. |
| 6,196,454 | B1 | 3/2001 | Sadlier |
| 6,237,820 | B1 | 5/2001 | Saxton |
| 6,257,485 | B1 | 7/2001 | Sadlier et al. |
| 6,260,756 | B1 | 7/2001 | Mochizuki et al. |
| 6,286,754 | B1 | 9/2001 | Stier et al. |
| 6,287,247 | B1 | 9/2001 | Dees et al. |
| 6,378,766 | B2 | 4/2002 | Sadlier |
| 6,422,456 | B1 | 7/2002 | Sadlier |
| 7,281,650 | B1 | 10/2007 | Milan |
| 7,458,504 | B2 * | 12/2008 | Robertson et al. ..... 229/403 |
| 2007/0228134 | A1 | 10/2007 | Cook et al. |

FOREIGN PATENT DOCUMENTS

| | | | |
|---|---|---|---|
| GB | 649299 | A | 1/1951 |
| GB | 1167861 | A | 10/1969 |
| GB | 1366310 | A | 9/1974 |
| GB | 2016640 | A | 9/1979 |

* cited by examiner

MULTI WALLED CONTAINER AND METHOD

CROSS-REFERENCE TO RELATED APPLICATIONS

This application is a Continuation of and claims priority to U.S. application Ser. No. 11/548,858 filed Oct. 12, 2006 now U.S. Pat. No. 7,458,504 to Ronald D. Robertson entitled Multi Walled Container and Method, the entire disclosure of which is incorporated herein by reference.

BACKGROUND OF THE INVENTION

The present invention relates to containers used for holding ingestibles for consumption, including drinks and foods and in particular those foods that are served hot, although, it is usable with cold ingestibles as well. An ingestible can be a food product or a drink particularly those products with a high amount of free liquid, e.g., soups, coffee, tea and the like. Such containers are well known in the industry.

An example of such a container in the form of a cup may be found in U.S. Pat. No. 5,425,497. This patent discloses a formed cup having a frustoconical sidewall, a rolled upper lip and a bottom wall secured to the sidewall. A cup holder can be used to encircle a portion of the cup sidewall and includes a member that is assembled at the place of use by having opposite end portions of the cup holder provided with opposing slits to help accomplish assembly of the cup holder. The cup holder is designed to be separable from the cup and capable of being carried in a pocket, purse or brief case until need for use. The cup sidewall is then inserted into a formed cup holder. This required both close dimensioning of the sidewall and of the wrap to ensure that the wrap is properly positioned on the cup. The texture of the cup holder has nubbins and depressions creating air gaps between the user's hand and the cup. The wrap, necessarily has projecting free end portions. Other structures are known in the art, examples of which may be found in U.S. Pat. No. 2,979,301 which also discloses the use of a cup holder in combination with a cup; U.S. Pat. No. 2,028,566 which shows a corrugated cup holder; U.S. Pat. No. 3,157,355 which showed a plastic cup having a plurality of formed conical protrusions 33 projecting outwardly from the sidewall of the cup which is complicated and difficult to form on a paper cup; U.S. Pat. No. 3,123,276 which shows inner and outer cup portions held in place apparently by interengaging ledges when the cups are stacked or nested together; a simple structure is shown in U.S. Pat. No. 3,049,277 having an outer wrap overlying a portion of the cup sidewall; and a complicated structure is shown in U.S. Pat. No. 2,591,578.

The containers of the prior art tend to be either complex in construction, or expensive, or require manual labor at locations where manual labor is at a premium or may result in faulty containers which could lead to liability in the event assembly has not been properly achieved. Another problem is to obtain sufficient insulation particularly when a hot liquid is to be served in the container, in an inexpensive manner while still providing sufficient resistance to bending and grip capability for the user to properly handle the filled container.

Thus, there is a need for an improved container for ingestibles.

SUMMARY OF THE INVENTION

A multi walled container is provided for the storing of ingestibles such as hot coffee and the like. The container includes a cup sidewall having opposite end portions. One end portion defines an open mouth and the other end portion is closed with a bottom wall member to form the cup and define a storage compartment. A sleeve member is positioned outwardly of and overlying a portion of the sidewall and is secured thereto. The sleeve member includes a plurality of spaced apart protuberances which extend inwardly from an inside surface of the sleeve member forming a gap between portions of the exterior of the cup sidewall and the interior surface of the sleeve. At least some of the protuberances have a through opening adjacent an apex of the respective protuberance.

The present invention also involves a method of making a multi walled container. The method includes forming a cup with a sidewall having an exterior surface and a bottom wall connected to the sidewall. The cup has an open mouth defined by a portion of the sidewall. A sleeve member is formed having an interior surface conforming generally in shape to a substantial portion of the exterior surface of the cup sidewall. The sleeve member has a plurality of spaced apart protuberances projecting inwardly from the interior surface of the sleeve member. The method further includes securing the sleeve member to the sidewall to prevent longitudinal movement between the sidewall and sleeve member after securement is effected. The above structure likewise has a physical appearance that conveys or suggests to the user that the cup is insulated. Additionally, the outside sleeve member, while dimpled may attractively contain printing, logos or other indicia thereon.

BRIEF DESCRIPTION OF THE DRAWINGS

Like numbers throughout the various Figures designate like or similar parts and/or structure.

DETAILED DESCRIPTION

Figure 1:
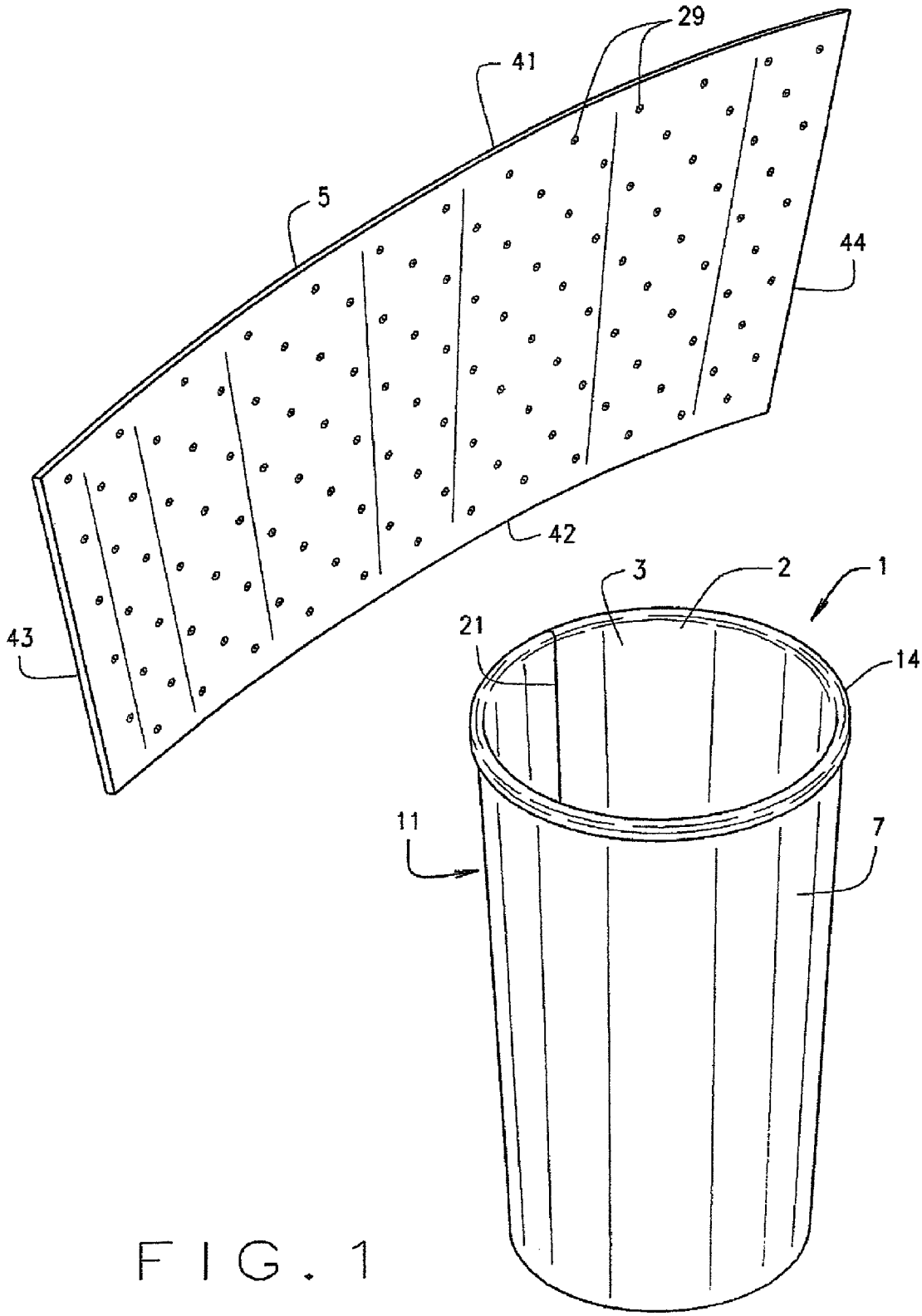
FIG. 1 is an exploded view of a container having a cup portion and sleeve member portion with the sleeve member portion being shown unattached and in a flat configuration.

The reference numeral 1 designates generally a container shown in the form of a sleeved cup having an upwardly opening mouth 2 providing communication to a chamber 3 adapted for storing ingestibles which can include drinks and/or food and in particular ingestibles with a high water content. The container 1 includes a sleeve 5 secured to in surrounding relationship to a portion of the sidewall 7 of the cup. The sleeve 5 is secured to the sidewall 7 to prevent relative movement in a longitudinal direction therebetween.

Figure 3:
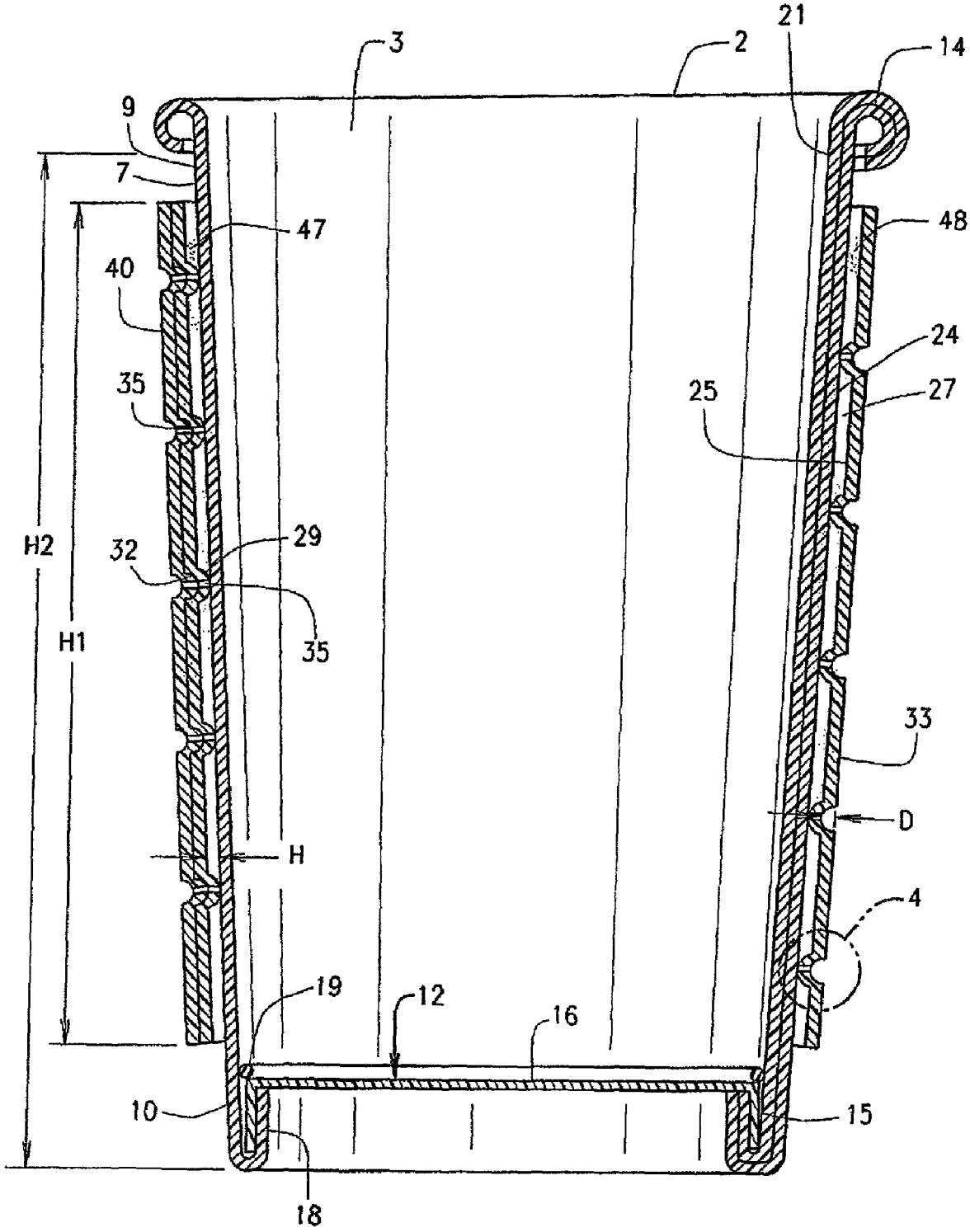
FIG. 3 is a cross sectional view taken along the line 2-2 of the container of FIG. 2.

The container 1 includes a cup body designated generally 11 that includes the sidewall 7, and a bottom wall 12. The sidewall 7 has opposite end positions 9, 10 with the end position 9 defining the open mouth 2 adjacent a lip 14 which can be formed by rolling a portion of the sidewall 7. In a preferred embodiment, the sidewall 7 is made of paperboard and preferably coated paperboard to resist the migration of liquids contained in the storage chamber 3 into the sidewall 7. Lips 14 are well known in the art and is best seen in FIG. 3. The lip 14 provides ease of use as well as resistance to bending of the upper portion of the sidewall 7 during use and may further form an area to engage or lock a lid (not shown) thereto. Opposite the end portion 9, is the lower end portion 10 of the sidewall 7 that is closed with the bottom member 12. The bottom member 12 as shown, includes a bottom panel 16 having a depending skirt 15 which is secured to the sidewall 7 by a reverse bend 18 portion of the sidewall 7. Securement can be achieved by adhesive, sonic welding, sealants, or the like. A bead of sealant may also be provided at the junction between the panel 16 and sidewall 7 as at 19. Construction of the cup portion 11 of the container 1 as just described is well known in the art. Generally, the sidewall 7 is frustoconical and has a generally circular transverse cross sectional shape of varying diameter depending upon where the cross section is taken between the open mouth 2 and the bottom end 10 of the sidewall 7. The taper of the sidewall 7 permits nesting for storage and shipping. The sidewall 7 is preferably formed from a blank, e.g., by wrapping about a mandrel and is provided with an overlapping seam 21 extending generally longitudinally at least between the mouth 2 and end 10. The seam 21 can be formed by overlapping edge margin portions of the blank from which a sidewall 7 is made and adhering the overlapping margin portions together as by adhesive, sonic welding or the like. The exposed edges of the sidewall 7 at the seam 21 can be sealed to prevent the migration of liquids into the material comprising the sidewall 7. The thickness of the material of the sidewall 7 can be on the order of 0.01 to about 0.03 inches. The container of the present invention can have a chamber 3 volume on the order of, for example, about 4 fluid ounces to about 16 fluid ounces although, larger or smaller containers can be made.

A sleeve 5 surrounds and overlies a substantial portion of the sidewall 7 and has an interior surface portion 25 (FIG. 3) spaced from the exterior surface 24 of the sidewall 7. The surface 24 is preferably smooth and uninterrupted except at the seam 21 at least adjacent the surface 25. As shown, the sleeve 5 has an interior surface 25 that is sized and shaped substantially, but slightly larger circumferentially, to the size and shape of the exterior surface 24 with an air gap 27 being provided between the interior sleeve surface 25 and the exterior sidewall surface 24. The standoff between the interior surface 25 and exterior surface 24 can be accomplished by the use of inwardly projecting protuberances 29 that can be easily formed into the sleeve 5 when in blank form by, e.g., rolling with an embossing roller or pressing with a generally planar embossing die plate having a plurality of projecting forming pins on a forming surface. The protuberances 29 have a height H from the surface 24 on the order of 0.01 to about 0.06 inches. The protuberances 29 may be formed at any suitable time during the manufacturing process and can be formed prior to die cutting or otherwise forming of the sleeve blank or after formation of the blank for the sleeve. The blank for forming the sleeve 5 may also be processed to form the protuberances 29 during the cup forming process for example, during a machine dwell period while the blank is waiting to be formed about the sidewall 7. The protuberances 29 have a hollow dimple or cavity 32 impressed into the outside surface 33 of the sleeve 5. As shown, the dimples 32 are generally round as best seen in FIG. 1 and would have a transverse dimension, for example, a diameter on the order of about 0.06 to about 0.18 inches at the outside surface.

The protuberances 29 are preferably in the shape of a portion of a sphere. The depth D of a dimple 32 is approximately equal to the height H as described above. The protuberances 29 and hence the dimples 32 may be positioned in any desired pattern and spacing. Preferably, the center to center spacing of the protuberances, based on the immediately adjacent protuberances is at least about ¼ of an inch to approximately ¾ inches. The protuberances 29 may be arranged in random patterns or regular patterns. Additionally, the sleeve 5 may be provided with dimples 32 and hence protuberances 29 in patterns for example, geometric patterns, letters, symbols or other devices for advertising and/or informational purposes. The exterior surface 33 of the sleeve 5 may also be provided with printed indicia 34 for informational and/or advertising purposes and may also be provided with color or colors as desired. The surface 33 is generally smooth and continuous without substantial projections to provide for easy and sure gripping of the container 1 at any position therearound. The printed indicia 34 is preferably applied prior to forming the protuberances 29. It should be noted that the dimple size(s) and whatever pattern that has been selected for the dimples, convey a message to the user that the cup is insulated without interfering or obscuring the printed message or logos thereon.

The sleeve 5 may be assembled prior to securing to the sidewall 7 or may be wrapped about a formed sidewall 7 and formed in place about the sidewall 7. As best seen in FIG. 2, the sleeve 5 can be provided with a longitudinally extending seam 40 formed by overlapping side edge margin portions of the blank from which the sleeve 5 is formed. Such overlapping seams are well known in the art. As shown, the seams 40, 21 are circumferentially spaced apart and preferably are positioned on opposite sides of the container 1 and hence sidewall 7. The abutting surface portions of the overlapping edge margin portions can be secured together as for example by adhesive, heat sealing, ultra sonic welding or the like depending upon the type of material from which the sleeve 5 is made. Preferably, the sleeve 5 is made from a paperboard material and may be coated for either esthetic purposes and/or providing resistance to migration of liquids thereinto. The sleeve 5 may also be absorbent to absorb spills or dribbles. As seen in FIG. 1, if the sidewall 7 of the container 1 is frustoconical, the top and bottom edges 41, 42 respectively would preferably be curved and the side edges 43, 44 would preferably be tapered inwardly from the edge 41 to the edge 42.

Figure 2:
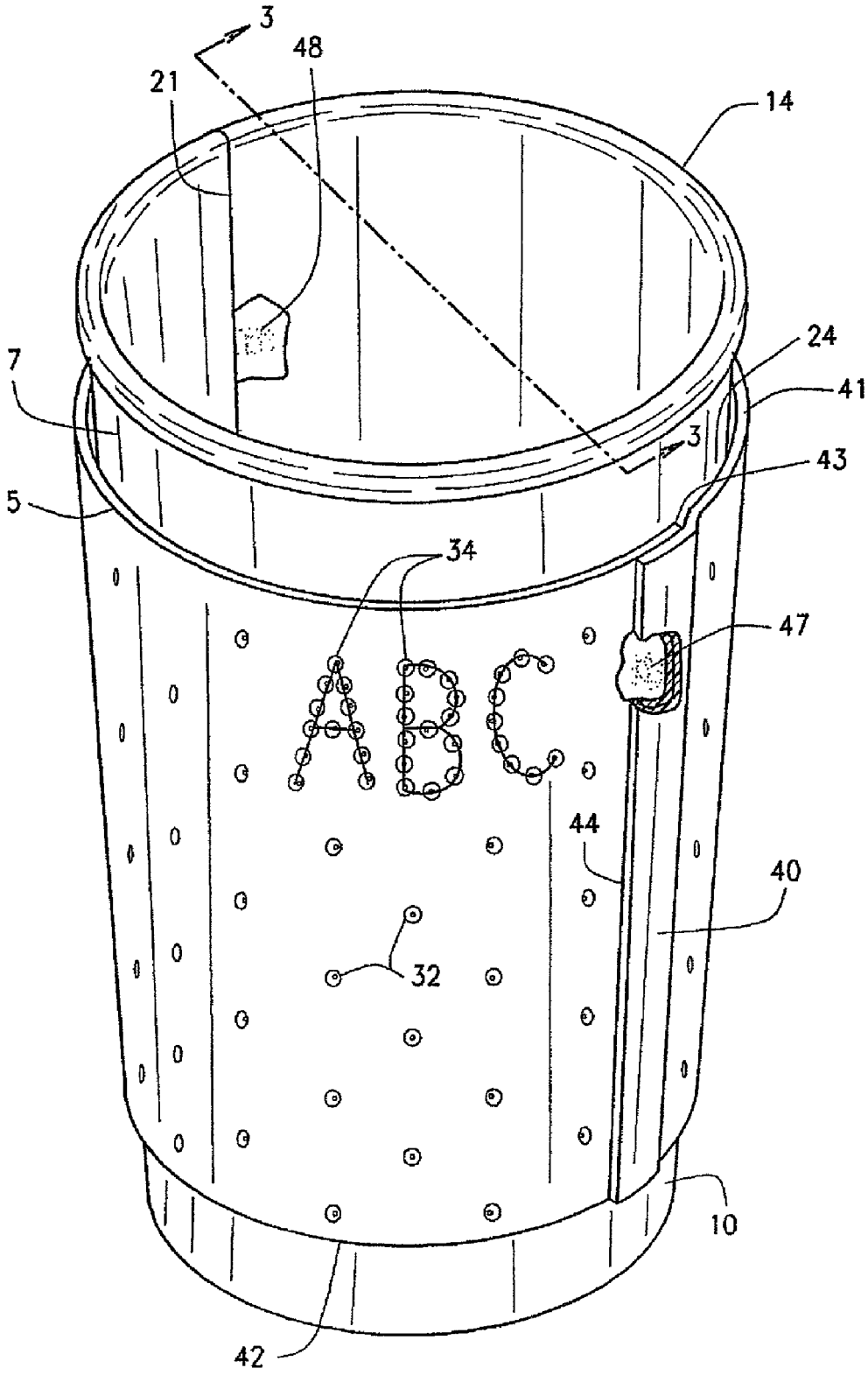
FIG. 2 is a perspective elevation view of the container of FIG. 1.
Figure 4:
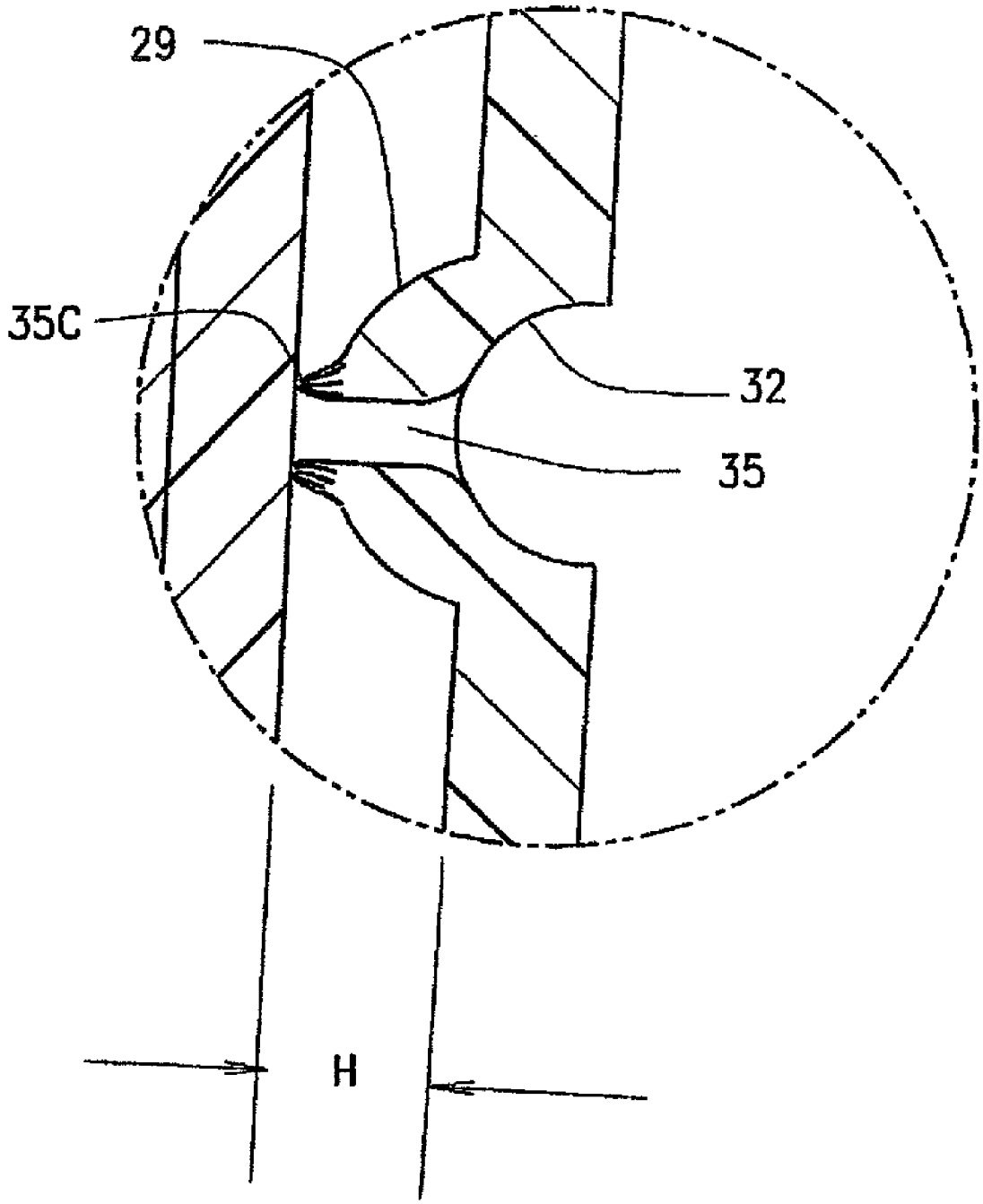
FIG. 4 is an enlarged view of the portion of the container in the balloon 4 of FIG. 3.

As best seen in FIGS. 1 and 3, the protuberances 29 are formed each with a through hole 35 positioned adjacent the apex of the respective protuberance. The holes 35 are formed during the formation of the protuberances 29 through the use of a forming die having a plurality of pointed members projecting from the forming surface to pierce the material of the sleeve 5. The blank for the sleeve 5 is then punched through so the small needle like spikes used in the forming die puncture through the sleeve material displacing the paper to the backside of the sleeve where it forms a crater like feature with projecting frayed or rough fibrous rim or collar 35C projecting for engagement with the exterior surface 24 of sidewall 7. The rim 35C is best seen in the enlarged view seen in FIG. 4. A rim 35C may partially or completely surround a respective hole 35. The collar 35C provides more height H and is formed from paper fibers when the sleeve 5 is made from fibrous paper material. Not all the holes 35 may have a rim 35C. Material is not removed from the sleeve blank, but rather is the material deformed or upset outwardly of the surface 25. The protuberances 29 and holes 35 can be created when the blank for the sleeve 5 is die cut or within the overwrapping machine. Some of the holes 35 may close after removal of the forming tool.

In a preferred embodiment, the sleeve 5 is adhesively secured to the sidewall 7. As best seen in FIG. 2, adhesive spots 47, 48 may be applied to the surface 24 prior to mounting the sleeve 5 to the sidewall 7. The adhesive may also be applied to the sleeve 5 or to both the sleeve 5 and sidewall 7 prior to joinder. In a further preferred embodiment, the adhesive spots 47, 48 are each applied at the seams 40, 21 respectively. Other adhesive locations may be provided if desired.

The upper edges of the adhesive spots 47, 48 are preferably positioned adjacent the upper edge 41 of the sleeve 5 for example, within about ¼ inches to ¾ of an inch from the edge 41. Preferably the width of the adhesive spots 47, 48 is sufficient to bridge the width of the seams 40, 21 respectively. It is also contemplated that the seams 21 and 40 could likewise be secured by heat welding a polymeric coating, e.g., polyethylene, on the paperboard and the seam 40 could be a butt seam heat welded to the exterior surface 7.

A lid, not shown, may be provided at the place of filling of the container 1. Such lids are well known in the art and may be provided with pre-formed access openings. Such a lid may also be provided with a skirt with an internally projecting rib to lock over the lip 14. As shipped from the manufacturing facility, the container 1, except for the lid, is a complete container with the sleeve 5 secured to the sidewall 7 eliminating the need for subsequent container forming steps at the location of use. The tapered configuration of the sidewall 7 and the sleeve 5 permits nesting of the containers one within another, for efficiency of use of storage space. Preferably, the sleeve 5 has a height H1 that is at least half the height H2 from the bottom of the sidewall 7 to the bottom of the lip 14 as best seen in FIG. 3. Preferably the height H1 is at least about 70% and preferably at least about 80% of the height H2. In use, the dimples 32 enhance the gripability, insulation and esthetics of the container 1.

Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

The invention claimed is:

1. A multi walled container for storing ingestibles the container comprising:

a sidewall having opposite first and second opposite end portions, said first end portion defining an open mouth, said sidewall having an exterior surface;

a bottom wall adjacent the second end portion and closing the second end portion, said sidewall and bottom wall defining a storage chamber;

a sleeve member positioned outwardly of and overlying at least a portion of the sidewall and secured thereto, said sleeve member including a plurality of spaced apart protuberances extending inwardly from an inside surface of the sleeve member forming a gap between portions of the exterior and interior surfaces, wherein at least some of said protuberances each have a through opening adjacent an apex of the respective protuberance and wherein at least some of said protuberances include a fibrous rim proximate said through opening, said fibrous rim projecting inwardly for engagement with said exterior surface of said sidewall to maintain said gap between said sleeve member inside surface and said sidewall exterior surface.

2. The container of claim 1 wherein the sidewall and sleeve member being made of paperboard.

3. The container of claim 2 wherein the sidewall and sleeve member each having a side seam formed from respective overlapping side edge margin portions.

4. The container of claim 3 wherein the side seam of the sleeve member being circumferentially spaced from the side seam of the sidewall.

5. The container of claim 4 wherein the side seams being positioned generally on opposite sides of the container.

6. The container of claim 4 wherein the sleeve member is secured to the sidewall at a location adjacent each side seam.

7. The container of claim 6 wherein the side seams being positioned generally on opposite sides of the container.

8. The container of claim 6 wherein the sleeve member being secured to the sidewall with at least two separate zones of adhesive.

9. The container of claim 8 wherein the sleeve member having opposite top and bottom edges, said top edge being adjacent the first end portion and the bottom edge being adjacent the second end portion, said at least two zones of adhesive being positioned between the exterior surface and the inside surface adjacent the top edge.

10. The container of claim 9 wherein the at least two zones of adhesive including a first zone and a second zone positioned on opposite sides of the container.

11. The container of claim 1 wherein said protuberances are formed by piercing said sleeve member with pointed members.

12. The container of claim 1 wherein said rim of fibrous material partially surrounds said through opening.

* * * * *